US011606847B2

(12) United States Patent
Becker et al.

(10) Patent No.: US 11,606,847 B2
(45) Date of Patent: Mar. 14, 2023

(54) SELF-BAKING ELECTRODE

(71) Applicant: Rheinfelden Carbon GmbH & Co. KG, Rheinfelden (DE)

(72) Inventors: Robert Becker, Reinfelden (DE); Stefan Bauer, Ruhstorf (DE)

(73) Assignee: Rheinfelden Carbon Products GmbH, Rheinfelden Baden (DE)

( * ) Notice: Subject to any disclaimer, the term of this patent is extended or adjusted under 35 U.S.C. 154(b) by 0 days.

(21) Appl. No.: 15/734,626

(22) PCT Filed: Jun. 3, 2019

(86) PCT No.: PCT/EP2019/064364
§ 371 (c)(1),
(2) Date: Dec. 3, 2020

(87) PCT Pub. No.: WO2019/233955
PCT Pub. Date: Dec. 12, 2019

(65) Prior Publication Data

US 2021/0235556 A1 Jul. 29, 2021

(30) Foreign Application Priority Data

Jun. 3, 2019 (WO) ..... PCT/EP2018/064364

(51) Int. Cl.
*H05B 7/09* (2006.01)
*H05B 7/107* (2006.01)

(52) U.S. Cl.
CPC ..... *H05B 7/09* (2013.01); *H05B 7/107* (2013.01)

(58) Field of Classification Search
CPC ..... H05B 7/09; H05B 7/107; H05B 7/109
USPC ..... 373/89
See application file for complete search history.

(56) References Cited

U.S. PATENT DOCUMENTS 1,442,031 A * 1/1923 Soderberg ..... H05B 7/107 373/99
4,692,929 A * 9/1987 Cavigli ..... H05B 7/09 373/89
5,577,065 A * 11/1996 Sales ..... H05B 7/09 373/91

FOREIGN PATENT DOCUMENTS

| | | | |
|---|---|---|---|
| CN | 104427673 | A | 3/2015 |
| DE | 1161652 | | 1/1964 |
| DE | 2521873 | | 11/1976 |
| DE | 4010353 | A1 | 10/1991 |
| EP | 0179164 | A1 | 4/1986 |

* cited by examiner

*Primary Examiner* — Dana Ross
*Assistant Examiner* — Joe E Mills, Jr.
(74) *Attorney, Agent, or Firm* — The Webb Law Firm

(57) ABSTRACT

An apparatus for a self-baking electrode includes an electrode having at least three zones, a first zone containing uncarbonized carbon-containing composition, a second zone which adjoins the first zone and in which the carbon-containing composition is present in a paste-like or liquid form, a third zone which adjoins the second zone and in which the carbon-containing composition is present in carbonized form, and a cylindrical housing which encloses at least the first and second zones. A tube can be lifted and lowered in a vertical direction at least partly within the zones and an extendable holding element for taking up tensile forces runs partly within the tube and partly outside the tube where a first end of the holding element (101) can be detachably connected to a fastening element, a second end of the holding element enters the third zone and is anchored there.

22 Claims, 5 Drawing Sheets

SELF-BAKING ELECTRODE

CROSS-REFERENCE TO RELATED APPLICATIONS

This application is the United States national phase of International Application No. PCT/EP2019/064364 filed Jun. 3, 2019, and claims priority to International Application No. PCT/EP2018/064657 filed Jun. 4, 2018, the disclosures of each of which are hereby incorporated by reference in their entireties.

BACKGROUND OF THE INVENTION

Technical Field

The invention relates to an apparatus for a self-baking electrode and also to a process for operating this apparatus.

Prior Art

The technology of self-baking electrodes, known as Söderberg electrodes, goes back to the beginning of the 20th century. The term Söderberg electrode refers to self-baking or self-calcining electrodes having the following technical principle: an electrode composition (particulate and solid at room temperature) comprising carbon carriers such as anthracite, petroleum coke, graphite and a hard coal tar pitch binder melts as a result of electrically produced energy and process heat at 120-200° C. and forms a liquid to paste-like, uncarbonized composition. At 500° C. and above the electrode composition goes over into the solid, namely carbonized state and its electrical resistance decreases. At the electrode tip, which is surrounded by a plasma or electric arc, the electrode composition is present in a graphitized state at temperatures of more than 2000° C. This electrode technology is primarily employed in an electric arc furnace, for example in the reduction of ferrous alloys. The Söderberg electrode for melting-reduction furnaces for the production of silicon comprises a cylindrical housing in the form of a sheet metal outer wall, with a continuously lengthenable graphite electrode which is smaller than, i.e. has a smaller diameter than, the sheet metal outer wall being conveyed within the sheet metal outer wall. The sheet metal outer wall is continually filled with electrode composition, for example in the form of briquettes. In order to compensate for the loss of the sheet metal outer wall as a result of burning, further sheet metal outer walls are welded on and the outer wall is displaced in the vertical direction. The graphite electrode, the main function of which is to hold the Söderberg composition, can be moved up and down in the vertical direction within the sheet metal outer wall. The electrode composition is moved within the sheet metal outer wall by the downward movement of the graphite electrode. The graphite electrode is continually lengthened by joining together of individual graphite electrode pieces. Each region in which a graphite electrode piece adjoins a further graphite electrode piece and is joined thereto is referred to as nipple zone. The replacement and lengthening of the graphite electrode lengthens each part of the electrode which is consumed by the reduction process (known as electrode burning). The energy input which allows the baked and electrically conductive electrode to be formed from the electrode composition results firstly from the process heat of the furnace and secondly from the electric current which is introduced into the outer wall via contact jaws. The use of a graphite electrode which runs in the core of the actual Söderberg electrode, correspondingly holds the electrode composition and owing to its good electrical conductivity also contributes to transport of electric current has for years been established as conventional technology in the production of silicon metals. The term composite technology is used in this context.

However, a problem associated with the Söderberg electrode having a graphite electrode in the core has been found to be the high thermal conductivity of graphite. Heat transport within the graphite electrode leads to a large temperature gradient between electrode surface and middle of the electrode. The replacement, namely the relative motion of the electrode composition and the sheet metal outer wall, is sometimes made difficult thereby. Furthermore, it has been ensured that the graphite electrode is arranged in the center, since otherwise nonuniform distribution of electric current leads to unsymmetrical baking and mechanical stresses associated therewith, which can have an adverse effect on the material properties of the self-baking electrode, as a result. In such cases, there is an increased occurrence of undesirable electrode fractures. Furthermore, the nipple zones represent weak points in the graphite electrode, which likewise promote electrode fracture.

SUMMARY OF THE INVENTION

It is an object of the present invention to overcome at least one disadvantage known from the prior art.

This object is achieved by the features of the apparatus described herein.

The apparatus of the invention for a self-baking electrode, where the electrode has at least three zones, namely a first zone containing an uncarbonized carbon-containing composition, a second zone which adjoins the first zone and in which the carbon-containing composition is present in a paste-like to liquid form and a third zone which adjoins the second zone and in which the carbon-containing composition is present in carbonized form, comprises a tube which can be lifted and lowered in the vertical direction (y) and an extendable holding element for taking up tensile forces. The holding element is an extendable rigid element, for example a rod, or an extendable flexible element, for example a rope. Both elements consist at least partly of a heat-resistant material which is resistant up to a temperature of at least 1000° C. As material, use is made of, for example, a highly heat-resistant steel or materials based on carbon fibers. At least the first and second zones of the electrode are surrounded by a cylindrical housing. The tube runs partly within the cylindrical housing, passes through the first and second zones and ends above the third zone. The holding element runs partly within the tube and partly outside the tube. A first end of the holding element is detachably connectable to a fastening element, and a second end of the holding element enters the third zone and is anchored there.

The tube serves to exercise shear or compressive forces on the carbon-containing composition. It can be lifted and lowered in the vertical direction. In this way, the carbon-containing composition can be moved relative to the cylindrical housing. This process is referred to as replacement. For this purpose, the tube has appropriate means which make this vertical movement possible. These means are connected to the constructional plant structure which surrounds the apparatus of the invention. The means are, for example, two clamping rings which are, viewed in the vertical direction, arranged opposite one another and are connected to one another by replacement hydraulics, for example displacement cylinders. The first clamping ring is referred to as the upper clamping ring and the second clamping ring which is located, viewed in the vertical direction, underneath the first clamping ring is referred to as lower clamping ring. The tube runs within these two clamping rings and is clamped by these. The replacement can be described as follows: the lower ring of the two clamping rings is opened, the upper clamping ring clamps the tube in place and is lowered hydraulically in the direction of the lower clamping ring. The lower clamping ring is closed and clamps the tube in place. The upper clamping ring is opened and hydraulically moved upward into its starting position.

The tube is preferably dimensioned so that existing means which were originally used for the graphite electrode can be used for replacement. During replacement, the tube is moved vertically within the first zone and the second zone but not within the third zone since the tube would here bake into the carbon-containing composition. The tube presses against the third zone.

In an illustrative embodiment, an end element which assists the replacement process is provided at one end of the tube which ends above the third zone.

In a further embodiment of the apparatus of the invention, a carrier element which presses the electrode against the first zone on lowering the tube is provided on each section of the tube which runs within the cylindrical housing. During replacement, this carrier element assists the movement of the carbon-containing composition relative to the cylindrical housing. The carrier element is configured so that continuous unhindered filling with particulate carbon-containing composition is possible. An illustrative embodiment is a star-like arrangement of individual carrier elements on the outside of the tube. Depending on the embodiment, only one carrier element or one end element or both can be provided on the tube.

In a further embodiment of the apparatus of the invention, the tube is provided with openings or perforations, for example holes or slits. In this way, the Söderberg composition can get into the interior of the tube. This is particularly useful when the tube (preferably made of aluminum) extends into zone 3 and is used for replacement (pressing). In this case, no carrier elements are needed. The tube then has to be able to be extended continuously and the installation of carrier elements to assist the replacement process is thus not necessary.

In one embodiment of the apparatus of the invention, the tube is arranged concentrically relative to the cylindrical housing of the electrode. This arrangement is ideal for distribution of the tensile and compressive forces.

In an illustrative embodiment, the tube is made of metal, for example of steel. Entry into the third zone is to be avoided since this would lead to undesirable introduction of iron.

In a further illustrative embodiment, the tube is made of a nonferrous metal, for example aluminum (and goes into the third zone).

The second function of the tube is to protect the extendable holding element which runs partly within the tube. This applies particularly in the first zone in which the carbon-containing composition is present in uncarbonized form. "Uncarbonized" means that the carbon-containing composition is, inter alia, present in particulate form, for example in the form of briquettes which are, as is customary in Söderberg technology, fed in continuously. In this zone in particular, the holding element would otherwise be subjected to high mechanical stress. In an illustrative embodiment, the holding element is made at least partly of carbon fibers. Carbon fibers are generally sensitive to shear and kinking movements, and effective protection against frictional and impact stresses, which occur particularly in the first zone, is needed. The tube performs this protective function. The holding element serves first and foremost to hold the electrode in place. It supports an electrode weight of a number of metric tons. Furthermore, heat resistance to 1000° C. and more has to be ensured since the holding element could otherwise not perform the necessary holding function.

Apart from the tube, the apparatus of the invention comprises the abovementioned extendable holding element for taking up tensile forces. A first end of the holding element is detachably connected to a fastening element. In a preferred embodiment, the fastening element is configured as a pin on which the holding element can be hung or as a clip into which the holding element can be clamped. The second end of the holding element enters the third zone. The carbon-containing composition here is present in carbonized form, namely solid form. Each region of the holding element which runs into this zone is "baked-in", namely anchored, there.

In one embodiment, the holding element is a rope in the form of a fiber composite composed of heat-stable fibers, for example in the form of a woven material, drawn-loop knitted fabric, form-loop knitted fabric, braid or with unidirectional fiber orientation or as a combination thereof. In a particular embodiment, the rope is a braid having preferably loose braiding in order to be able to minimize or eliminate kinks and friction in the event of tensile loading and be able to achieve a maximum tensile strength.

In a further embodiment, the rope is a braided tube weave composed of carbon fibers which is formed in an overlapping manner (for example about 20 cm) as loop and is sewn together by means of carbon fiber yarn. A loop element has a loop length optimized for the furnace and the user (a loop length of 4 m then corresponds to an extension of the electrode suspension of 2 m). In one embodiment, the rope comprises a plurality of loops joined to one another. A second loop goes through a first loop. Between the first loop and the second loop, there is a contact region which divides the second loop into a first loop part and a second loop part. A third loop goes through the two loop parts of the second loop. Between the second loop and the third loop, there is a contact region which divides the third loop into a first loop part and a second loop part (etc.). In this way, the rope can be extended continuously and without limit.

In a further embodiment, the contact region (or the contact regions) is coated between successive loops with a synthetic fiber composite (for example a woven material, drawn-loop knitted fabric, form-loop knitted fabric, braid or with unidirectional fiber orientation or as a combination thereof) as sheath to protect the contact region and to promote the elasticity of the loop chain. The synthetic fibers are, for example, aramid and/or paraaramid fibers such as Kevlar® (poly(p-phenylene-terephthalamide), Nomex® (aramid derived from m-phenylenediamine and isophthalic acid), Twaron®, Technora, Teijinconex, phenol-formaldehyde fibers such as Kynol, polyamide/polyimide fibers such as Kermel, polybenzimidazole fibers or fiber mixtures thereof.

In a further embodiment, one or more additional holding points (as anchoring in the Söderberg composition) can be created at regular or irregular intervals of, for example, 10 cm to 30 cm in the loop chain. For this purpose, short carbon fiber parts, for example rope pieces or cords, which are provided with knots at the ends are plaited into the loop or pushed through the loop. In an illustrative arrangement, the short carbon fiber parts are linked in as cross-member at a spacing of about 20 cm. In a further illustrative embodiment, the carbon fiber parts have a length in the range from 15 cm to 40 cm and a diameter in the range from 10 mm to 20 mm.

A thickening results in a contact region, since two loop parts are here joined to a further loop. This thickening has been found to be advantageous for anchoring the holding element in the carbon-containing composition, especially in the third zone.

In another embodiment, the holding element is a rod and comprises a plurality of individual rod elements which are operatively connected to one another. The individual rod elements are joined at their ends by operative connections to form a rod. In this way, the rod is continuously extended. An operative connection is to be understood, for example, as a screw connection or a plug connection.

In the process of the invention for operating the apparatus of the invention, the carbon-containing composition of the three zones is moved relative to the housing in a first step by vertical lowering of the tube. This step is repeated periodically until the tube has reached the end of the second zone. The load on the holding element is then decreased by reducing the tensile forces acting on the holding element, after which the holding element is extended and the extended holding element is secured by means of a fastening element. The tensile force is then applied to the extended holding element and the tube is lifted until it is again within the first zone. The first step is then carried out again.

In a preferred variant of the process of the invention, the extension of the holding element is effected by the holding element end which can be connected to the fastening element being extended by joining to at least one further loop or to at least one further rod element.

BRIEF DESCRIPTION OF THE DRAWINGS

The invention will be illustrated in more detail below with the aid of working examples in conjunction with the drawings. The Figures show.

DETAILED DESCRIPTION

Figure 1:
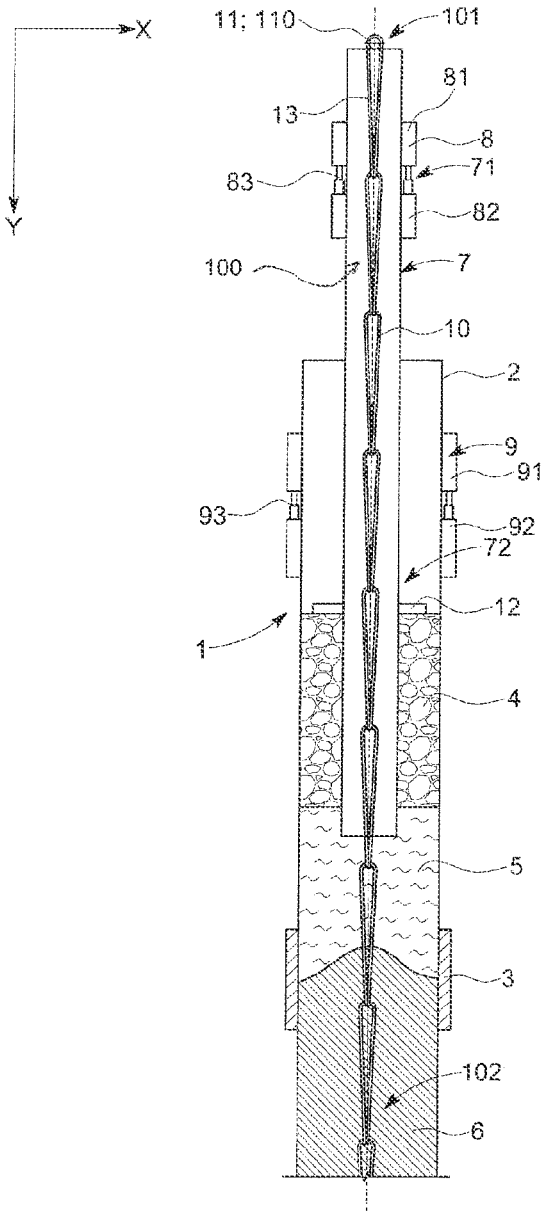
FIG. 1 schematically shows a partial section (longitudinal section) through a self-baking electrode with apparatus according to the invention, where the holding element is configured as a rope and the tube is equipped with carrier elements.

A partial section through the self-baking electrode with an apparatus according to the invention is shown schematically in FIG. 1. The electrode 1 comprises a cylindrical housing 2 in the form of a sheet metal outer wall which is continuously filled with particulate carbon-containing composition (briquettes). Means 9 which enable the housing to be moved in the vertical direction are arranged on the cylindrical housing 2. This is referred to as outer wall replacement. These means are connected to the constructional plant structure which surrounds the apparatus of the invention (not visible in FIG. 1). The means are, for example, two outer wall clamping rings 91 and 92 which are arranged opposite one another viewed in the vertical direction and are connected to one another by replacement hydraulics, for example displacement cylinder 93. The first outer wall clamping ring 91 is referred to as the upper outer wall clamping ring 91 and the second outer wall clamping ring 92, which is, viewed in the vertical direction, located underneath the first outer wall clamping ring, is referred to as lower outer wall clamping ring 92. The cylindrical housing 2, namely the sheet metal outer wall, runs within these two outer wall clamping rings 91, 92 and is clamped in place by these. The outer wall replacement is effected by alternate opening of the outer wall clamping rings 91, 92 and appropriate vertical movements triggered by the replacement hydraulics, namely the displacement cylinder 93. The outer wall replacement can be described as follows: the lowermost of the two outer wall clamping rings 92 is opened, the upper outer wall clamping ring 91 grips the cylindrical housing 2 firmly and is lowered hydraulically in the direction of the lower outer wall clamping ring 92. The lower clamping ring 92 is closed and clamps the cylindrical housing 2 firmly. The upper outer wall clamping ring 91 is opened and moved upward hydraulically to its starting position. Electric energy is supplied to the electrode via contact jaws 3, likewise arranged on the cylindrical housing 2. The thermal energy given off by the material being melted serves as further energy source. As a result of the energy input, the particulate carbon-containing composition, also referred to as uncarbonized Söderberg composition, goes over from a paste-like state into a liquid state and finally into a solid state. The solid state is also referred to as a carbonized Söderberg composition. This is shown in simplified form as three zones 4, 5 and 6 in FIG. 1. The first zone 4 comprises uncarbonized carbon-containing composition. In the second zone 5, this composition is present in paste-like to liquid form and in the third zone 6 is present in carbonized form. Zone 6 is shown only in part in FIG. 1. This zone is the region of the electrode 1 which dips into the reaction zone of the furnace (not visible in FIG. 1). In the reaction zone of the furnace, ore ($SiO_2$) is reduced to metallic silicon by addition of carbon (e.g. wood charcoal, low-ash coal and wood chips). The electric energy required (electric arc or plasma) is introduced by the electrode 1. The electrode 1 is consumed in the process.

FIG. 1 depicts a tube 7. This is partly arranged outside the electrode (region 71) and partly within the electrode (region 72). A section of the tube 7 which is arranged in the region 72 passes through the first and second zones 4, 5. The tube 7 does not reach the third zone 6 in which the carbon is present in carbonized and therefore solid form. In the embodiment shown schematically in FIG. 1, the tube 7 is arranged concentrically to the cylindrical housing 2.

As can likewise be seen in FIG. 1, a holding element 100 configured as rope 10 runs partly within the tube 7. The tube 7 protects the holding element 100 configured as rope 10 from mechanical damage, in particular in the first zone 4 of the electrode in which the carbon-containing composition is present in uncarbonized form, frequently in the form of sharp-edged particulate material. Unlike tube 7, a second end 102 of the holding element 100 which is no longer surrounded by the tube 7 goes into the third zone 6 of the electrode. It is fixed there in the carbonized carbon-containing composition, namely "baked-in" (second end 102 of the holding element 100 not visible in its entirety in FIG. 1). A first end 101 of the holding element which is located opposite the second end 102 is detachably connected to a fastening element 11. The fastening element 11 is, for example, a clamping means or, as shown schematically in FIG. 1, a pin 110 on which the holding element 100 configured as rope 10 is hung and from which the holding element 100 configured as rope 10 can be detached again. The holding element 100 serves first and foremost to take up tensile forces and hold the electrode 1.

Figure 2A:
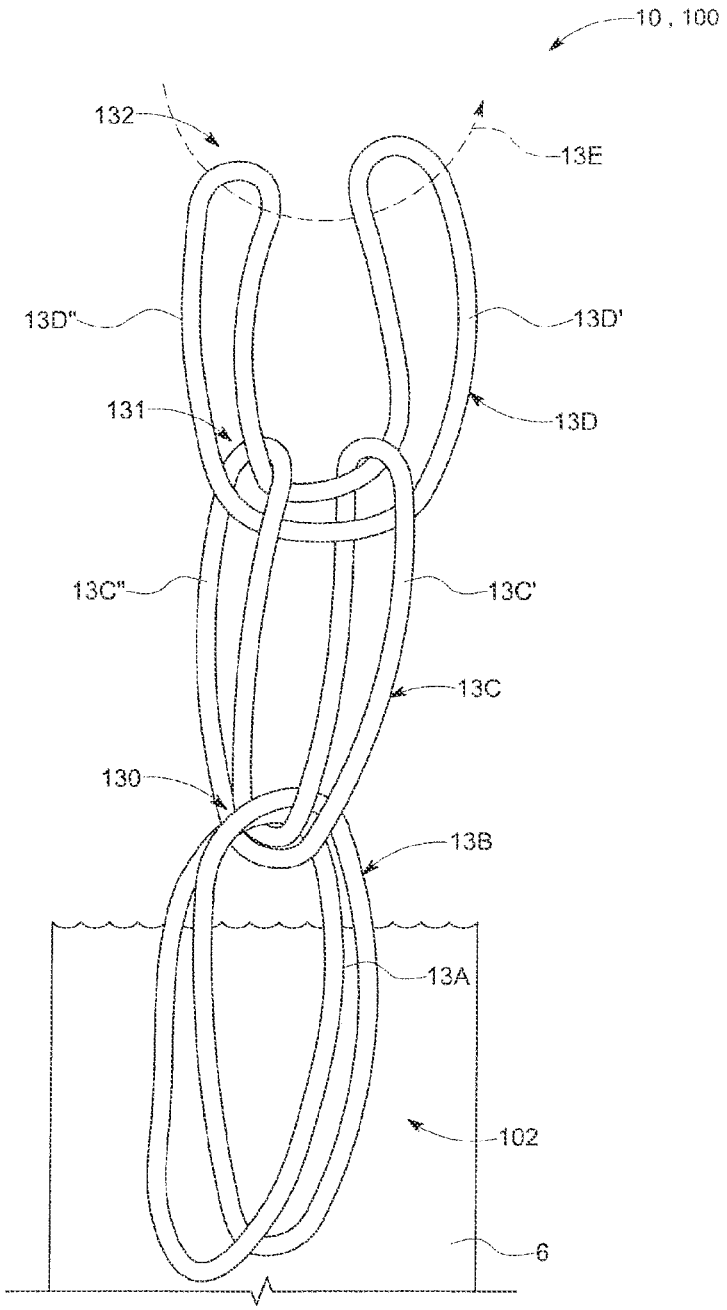
FIG. 2*a* schematically shows a part of the holding element and its construction from the individual loops.
Figure 2B:
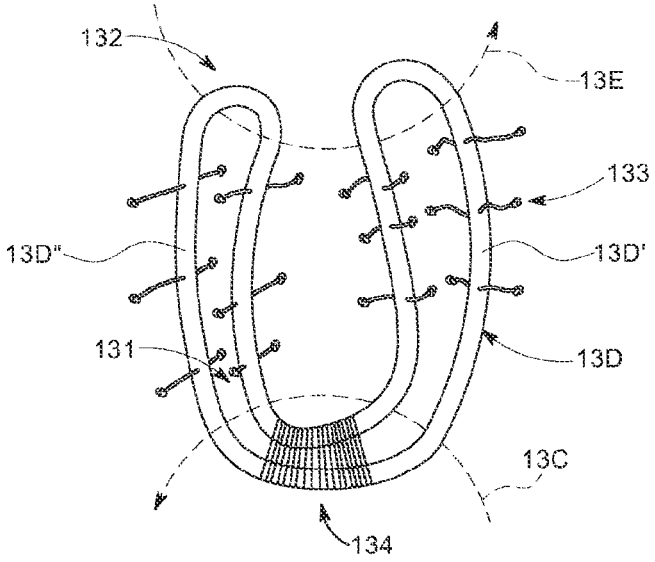
FIG. 2*b* schematically shows an individual loop of the holding element which is provided with carbon fiber parts pushed through and a sheath in the contact region.

In the embodiment depicted in FIG. 1, the holding element 100 configured as rope 10 comprises a plurality of interlocking loops 13. The first holding element end 101 configured as first loop 13 is hung on the pin 10. The holding element 100 configured as rope 10 is continuously extendable by joining a loop 13 to a second loop 13 and the second loop 13 to a third loop 13 (etc.). A loop 13 is configured as a closed ring. The individual loops are made of carbon fibers. A preferred embodiment of these loops 13 and the possibility of joining these individual loops 13 to one another is depicted in FIGS. 2*a* and 2*b*.

In each region 71 of the tube 7 which runs outside the electrode, means 8 for moving the tube 7 vertically are provided. These means are connected to the constructional plant structure which surrounds the apparatus of the invention (not visible in FIG. 1).

Such means 8 are, for example, two clamping rings 81, 82 which are arranged opposite one another in the vertical direction and are connected to one another by a displacement cylinder 83. The first clamping ring 81 is referred to as the upper clamping ring and the second clamping ring which, viewed in the vertical direction, is located underneath the first clamping ring is referred to as the lower clamping ring 82. The tube runs within these two clamping rings 81, 82 and is clamped in place by these. The replacement can be described as follows: the lowermost of the two clamping rings 82 is opened, the upper clamping ring 81 clamps the tube firmly and is lowered hydraulically in the direction of the lower clamping ring 82. The lower clamping ring 82 is closed and clamps the tube 7 firmly. The upper clamping ring 81 is opened and moved upward hydraulically to its starting position.

On actuation of the means 8, the tube 7 moves within the uncarbonized carbon-containing composition of the first zone 4 and the paste-like to liquid composition of the second zone 5 and exercises corresponding shear and/or compressive forces on the third zone 6. In the reduction process, the carbonized carbon-containing composition from the third zone 6 is consumed. The same also applies to the holding element 100, in particular to each region of the holding element which runs in the third zone 6. As a result of the replacement, carbonized carbon-containing composition is continuously supplied and is continually consumed by the continuous burning away of the electrode. To assist the replacement process, a carrier element 12 which on vertical movement of the tube 6 presses against the uncarbonized carbon-containing composition of the first zone 4 is optionally provided on the outside of the tube 7. The holding element 100 is continuously extendable. In the embodiment shown in FIG. 1, the loop 13 which forms the first end 101 of the holding element 100 is detached from the pin 110 and connected to a further loop 13 which is then hung on the pin 110 again. In this way, the holding element 100 is extended continuously as required.

FIG. 2*a* depicts parts of the holding element 100 made up of individual loops 13 connected to one another to form a rope 10. Each of the loops 13 is, in the embodiment shown in FIG. 2, configured as a closed ring. An illustrative material for the loops 13 is a woven material composed of carbon fibers. The third zone 6 consisting of carbonized solid Söderberg composition is shown schematically. In this third zone, the second holding element end 102 is fixed, namely "baked-in". In the embodiment shown in FIG. 2, the second holding element end 102 comprises two loops 13A and 13B. The two loops 13A and 13B are joined to one another by a third loop 13C. The third loop 13C goes through the two loops 13A and 13B. A contact region 130 between the two loops 13A and 13B and the third loop 13C results. As shown in FIG. 2, the loop 13C then comprises a first loop part 13C' and a second loop part 13C". The next loop 13D goes through these two loop parts. A contact region 131 then results between the first loop part 13C, second loop part 13C" and the loop 13D. The loop 13D comprises a first loop part 13D' and a second loop part 13D". A subsequent loop 13E (indicated as broken-line arrow in FIG. 2) goes through the first loop part 13D' and the second loop part 13D". A contact region 132 between the two loop parts 13D' and 13D" results. The loop 13E comprises a first loop part 13E' and a second loop part 13E", through which the next loop 13F goes (no longer visible in FIG. 2*a*). Depending on the desired length, the holding element 100 comprises a particular number of loops which are joined to one another in the manner described above. In the embodiment of a holding element 100 shown in FIG. 2*a*, as is used in the apparatus of the invention, the second holding element end 102 is formed by two loops 13A and 13B which are joined by the third loop 13C. It is conceivable to use another anchoring element, for example a type of hook, by means of which the second holding element end 102 is anchored in the carbonized Söderberg composition instead of the two loops 13A and 13B. The second holding element end 102 (not visible in FIG. 2) is, in a preferred embodiment, configured in the same way as, for example, the loop 13D depicted in FIG. 2*a*. The two loop parts 13D' and 13D" are hung on the pin 10 (cf. FIG. 1) and form the end of the holding element 100. As an alternative, an additional further anchoring element, e.g. likewise a hook, which connects the two loop parts to the pin can be provided between the loop parts and the pin 10.

FIG. 2*b* shows an enlarged view of the loop 13D (as per FIG. 2*a*) with loop parts 13D' and 13D" and the contact regions 131 and 132 thereof with loops 13C or 13E. The contact region 131 is provided with a coating or sheath 134 composed of a fiber composite. The loop 13D is provided with additional holding points 133 in the form of carbon fiber parts having knots at the ends.

Figure 3:
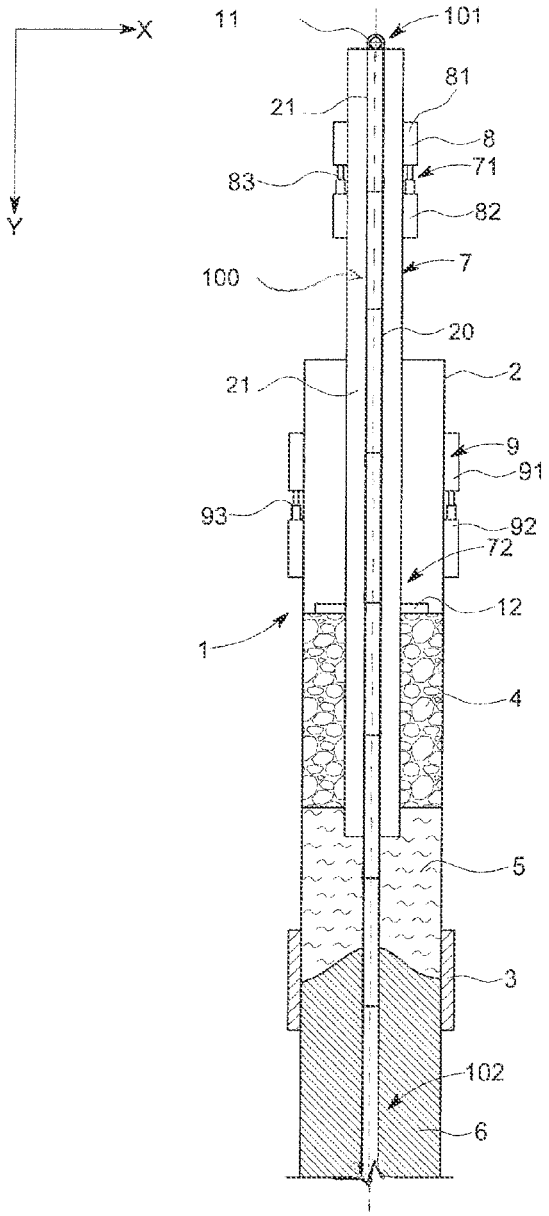
FIG. 3 schematically shows a partial section (longitudinal section) through a self-baking electrode with apparatus according to the invention, where the holding element is configured as a rod with individual rod elements and the tube is equipped with carrier elements.

FIG. 3 shows the depiction of FIG. 1 with the difference that the holding element 100 is configured as a rod 20 made up of individual rod elements 21. The rod (20) can be extended as required by juxtaposition of the rod elements (21). The rod elements (21) are operatively connected at their ends, for example by means of a plug or screw connection.

The first end of the holding element 101 comprises a fastening means 11 which in the embodiment of FIG. 3 is configured by way of example as clip into which an end of the rod element (21) can be clamped (clip not visible in FIG. 3).

Figure 4:
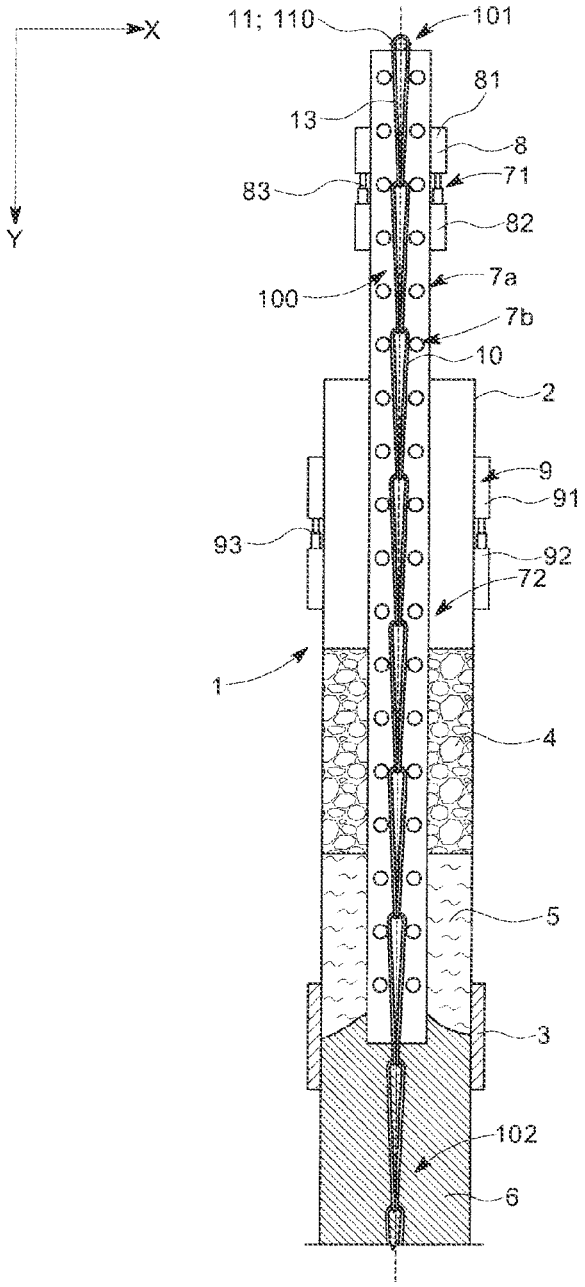
FIG. 4 schematically shows a partial section (longitudinal section) through a self-baking electrode with apparatus according to the invention, where the holding element is configured as a rope and the tube (without carrier elements) is perforated.

FIG. 4 shows the depiction of FIG. 1 with the difference that the tube 7*a* is perforated and no carrier elements are provided on the outside of the tube 7*a*. It can also be seen that the tube 7*a* goes into the third zone 6. The perforations 7*b* make it possible for the uncarbonized, carbon-containing composition to get into the interior of the tube 7*a*, which makes the use of carrier elements as in FIG. 1 (12) for exerting pressure on the uncarbonized, carbon-containing composition of the first zone 4 superfluous.

LIST OF REFERENCE NUMERALS

1 Electrode
2 Cylindrical housing
3 Contact jaws
4 First zone (uncarbonized Söderberg composition)
5 Second zone (paste-like to liquid Söderberg composition)
6 Third zone (carbonized, solid Söderberg composition)
7 Tube
7*a* Tube (perforated)
7*b* Perforations
71 Tube region outside the electrode
72 Tube region within the electrode
8 Means for moving the tube vertically
9 Means for moving the cylindrical housing vertically
10 Rope
100 Holding element
101 First holding element end
102 Second holding element end
11 Fastening element
12 Carrier element
13 A, B, C, D, E loops
13 C', C", D', D" loop parts
130, 131, 132 Contact region
133 Holding points
134 Sheath

The invention claimed is:

1. An apparatus for a self-baking electrode, the electrode comprising at least three zones, a first zone containing uncarbonized carbon-containing composition, a second zone which adjoins the first zone and in which the carbon-containing composition is present in a paste-like to liquid form, and a third zone which adjoins the second zone and in which the carbon-containing composition is present in carbonized form, and a cylindrical housing which encloses at least the first and second zones, the apparatus comprising:

a tube which can be lifted and lowered in a vertical direction, runs partly within the cylindrical housing, and passes through the first two zones and ends above the third zone, and an extendable holding element for taking up tensile forces which runs partly within the tube and partly outside the tube, where a first end of the holding element is able to be detachably connected to a fastening element and a second end of the holding element enters the third zone of the electrode and is anchored there.

2. The apparatus as claimed in claim 1, wherein the extendable holding element is an extendable rigid element or an extendable flexible element.

3. The apparatus as claimed in claim 2, wherein the extendable rigid element is a rod which consists at least partially of a heat-resistant material which is stable up to a temperature of at least 1000° C.

4. The apparatus as claimed in claim 2, wherein the extendable flexible element is a rope which consists at least partially of a heat-resistant material which is stable up to a temperature of at least 1000° C.

5. The apparatus as claimed in claim 4, wherein the rope comprises a plurality of loops and forms contact regions between two successive loops.

6. The apparatus as claimed in claim 5, wherein the individual loops of the plurality of loops are made at least partially of carbon fibers.

7. The apparatus as claimed in claim 5, wherein the contact regions are provided with a sheath.

8. The apparatus as claimed in claim 5, wherein the individual loops of the plurality of loops are provided with additional holding points.

9. The apparatus as claimed in claim 8, wherein the additional holding points are created in the loops by plaiting-in or pushing-through of short carbon fiber parts which are provided with knots at the ends.

10. The apparatus as claimed in claim 3, wherein the rod comprises a plurality of individual rod elements which are operationally connected to one another.

11. The apparatus as claimed in claim 1, wherein at least the first end of the holding element is configured as a loop or as a rod element, where the loop or the rod element is able to be detachably connected to the fastening element.

12. The apparatus as claimed in claim 1, wherein the holding element can be continuously extended from its first end by connecting a plurality of individual loops or a plurality of individual rod elements.

13. The apparatus as claimed in claim 1, wherein the holding element comprises a plurality of loops connected to one another and having a first loop, a second loop which goes through the first loop, a contact region formed between the first loop and the second loop and the second loop has a first loop part (13B') and a second loop part and a third loop goes through the two loop parts of the second loop.

14. The apparatus as claimed in claim 1, wherein the tube is unperforated and the tube is perforated.

15. The apparatus as claimed in claim 1, wherein the tube is arranged concentrically to the cylindrical housing of the electrode.

16. The apparatus as claimed in claim 1, wherein the tube is made of metal.

17. The apparatus as claimed in claim 1, wherein the tube is made of a nonferrous metal or alloy.

18. The apparatus as claimed in claim 1, wherein an end element which presses against the third zone when the tube is lowered is provided at an end of the tube which ends above the third zone.

19. The apparatus as claimed in claim 1, further comprising a carrier element provided on a part of the tube that runs within the cylindrical housing, the carrier element having a pressing surface which presses against the first zone of the electrode when the tube is lowered.

20. A process for operating an apparatus as claimed in claim 1, comprising:

a first step comprising moving the carbon-containing composition of the three zones relative to the cylindrical housing by vertical lowering movement of the tube, periodic repetition of the first step until the tube has reached the end of the second zone or enters the third zone, subsequently, decreasing the load on the holding element by reducing the tensile forces acting on the holding element, extending the holding element and securing the extended holding element by means of a fastening element, applying a tensile force to the extended holding element, lifting the tube until it is again located within the first zone, and recommencement with the first step.

21. The process as claimed in claim 20, wherein the extension of the holding element is effected by extending the end of the holding element which can be connected to the fastening element by connecting with at least one further loop or with at least one further rod element.

22. An electrode comprising:

at least three zones, a first zone containing uncarbonized carbon-containing composition, a second zone which adjoins the first zone and in which the carbon-containing composition is present in a paste-like to liquid form, and a third zone which adjoins the second zone and in which the carbon-containing composition is present in carbonized form;

a cylindrical housing which encloses at least the first and second zones; and an apparatus as claimed in claim 1.

* * * * *